US009772100B2

(12) United States Patent
Zhou et al.

(10) Patent No.: US 9,772,100 B2
(45) Date of Patent: Sep. 26, 2017

(54) DOUBLE-SIDED LED LIGHT STRUCTURE

(71) Applicant: MAINHOUSE (XIAMEN) ELECTRONICS CO., LTD, Xiamen (CN)

(72) Inventors: Nanqing Zhou, Xiamen (CN); RongKui Wu, Xiamen (CN)

(73) Assignees: MAINHOUSE (XIAMEN) ELECTRONICS CO., LTD., Xiamen, Fujian (CN); DONGGUAN BRIGHT YIN HUEY LIGHTING CO., LTD., Dong Guang, Guang Dong Province (CN)

( * ) Notice: Subject to any disclaimer, the term of this patent is extended or adjusted under 35 U.S.C. 154(b) by 207 days.

(21) Appl. No.: 14/702,777

(22) Filed: May 4, 2015

(65) Prior Publication Data

US 2016/0327213 A1 Nov. 10, 2016

(51) Int. Cl.

| | |
|---|---|
| ***F21K 99/00*** | (2016.01) |
| ***F21V 13/00*** | (2006.01) |
| ***F21V 29/77*** | (2015.01) |
| ***F21K 9/232*** | (2016.01) |
| ***F21K 9/69*** | (2016.01) |
| *F21V 5/04* | (2006.01) |
| *F21Y 115/10* | (2016.01) |

(52) U.S. Cl.

CPC ..... *F21V 29/773* (2015.01); *F21K 9/232* (2016.08); *F21K 9/69* (2016.08); *F21V 5/04* (2013.01); *F21Y 2115/10* (2016.08)

(58) Field of Classification Search

CPC . F21K 9/50; F21K 9/135; F21K 9/232; F21K 9/235; F21V 29/10; F21V 29/20

USPC ..... 362/294

See application file for complete search history.

(56) References Cited

U.S. PATENT DOCUMENTS

| | | | | |
|---|---|---|---|---|
| 7,575,346 | B1 * | 8/2009 | Horng | F21V 29/02 362/294 |
| 2005/0207156 | A1 * | 9/2005 | Wang | F21K 9/00 362/240 |
| 2014/0133145 | A1 * | 5/2014 | Choi | F21V 29/004 362/235 |
| 2014/0362573 | A1 * | 12/2014 | Imai | H01L 33/60 362/247 |

* cited by examiner

*Primary Examiner* — Karabi Guharay
(74) *Attorney, Agent, or Firm* — Leong C. Lei

(57) ABSTRACT

A double-sided LED light structure includes a casing that includes a base and a front chip arranged in the casing and electrically connected to the base and comprising an LED illuminant, wherein the casing has a rear end on which a rear chip that is electrically connected to the base and comprises an LED illuminant is mounted and a light-transmittable rear cover is set on and houses the rear chip. The front end of the light achieves concentrated illumination and the rear end achieves projection of supplemental light so that the LED light has a function of emitting light from two sides thereof to achieve a bettered three-dimensional illumination effect and also reduce the number of lights used.

8 Claims, 5 Drawing Sheets

DOUBLE-SIDED LED LIGHT STRUCTURE

TECHNICAL FIELD OF THE INVENTION

The present invention relates generally to a light-emitting diode (LED) light, and more particularly to an LED light structure that achieves light emission from two sides.

DESCRIPTION OF THE PRIOR ART

As shown in FIG. 1, a conventional LED projection light generally comprises a horn-shaped casing 2' having a rear end to which a base 1' is mounted and receiving an LED chip mounted therein. The casing 2' has a front end to which a lens 5' is mounted. Illumination light is projected from the front end of the casing 2'. Such an LED light has the characteristics of intensive brightness and concentrated illumination range. Particularly, the LED projection light is widely used for illumination of exhibited articles, where the light emission surface of the LED projection light is oriented to face the article to be illuminated. When such an LED projection light is deployed in an exhibition cabinet, the article to be illuminated can be exhibited in a brighter manner, while the surroundings are oppositely in a prominently dark condition. There are articles that cannot be properly display the coloring thereof by such concentrated light and supplemental lighting may be necessary for the surroundings, which requires additional lighting devices. This inevitably increases the complexity of lighting arrangement.

SUMMARY OF THE INVENTION

An object of the present invention is to provide a double-sided LED light structure, which provides not only a function of illuminating an article in a concentrated manner, but also supplemental lighting for the surroundings so as to achieve more prominently three-dimensional illumination of the article and also simplifying the arrangement of lighting device.

To achieve the above object, the present invention provides the following solution:

A double-sided light-emitting diode (LED) light structure comprises a casing that comprises a base and a front chip arranged in the casing and electrically connected to the base and comprising an LED illuminant, and is characterized in that the casing has a rear end on which a rear chip that is electrically connected to the base and comprises an LED illuminant is mounted. A light-transmittable rear cover is set on and houses the rear chip.

The casing is made of metal and has an outer surface on which raised ribs are distributed.

The casing comprises a heat dissipation hood received therein and having an outer circumference on which heat dissipation fins are distributed. The front chip mates the heat dissipation hood and is electrically connected to the base. The rear chip mates the rear end of the heat dissipation hood.

The casing is made of plastics and has an outer circumferential surface on which raised ribs are formed. The casing has an inner surface in which recesses are formed and respectively correspond to the raised ribs so as to correspond to the heat dissipation fins of the heat dissipation hood.

The heat dissipation hood is a metal cover corresponding to an internal cavity of the casing. Hollow openings are formed between adjacent fins.

The casing has a front end to which a lens is mounted.

The rear chip is in the form of a ring or a ring having a side opening, which is fit over the base to mate the casing.

The rear cover is an annular cover.

The rear cover comprises a casing having a curved surface.

By adopting the above solution, the double-sided LED light according to the present invention comprises a rear chip mounted to a rear end of a casing so that the front end of the light achieves concentrated illumination and the rear end achieves projection of supplemental light, whereby the LED light has a function of emitting light from two sides thereof to achieve a bettered three-dimensional illumination effect and also reducing the number of lights used.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
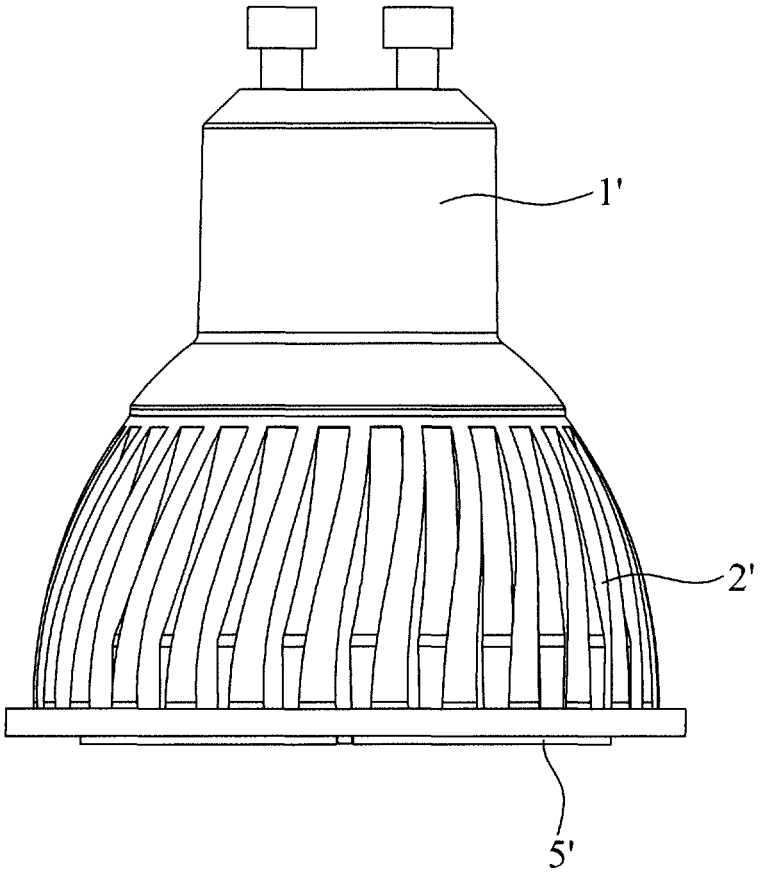
FIG. 1 is a schematic view showing a conventional light-emitting diode (LED) light.
Figure 2:
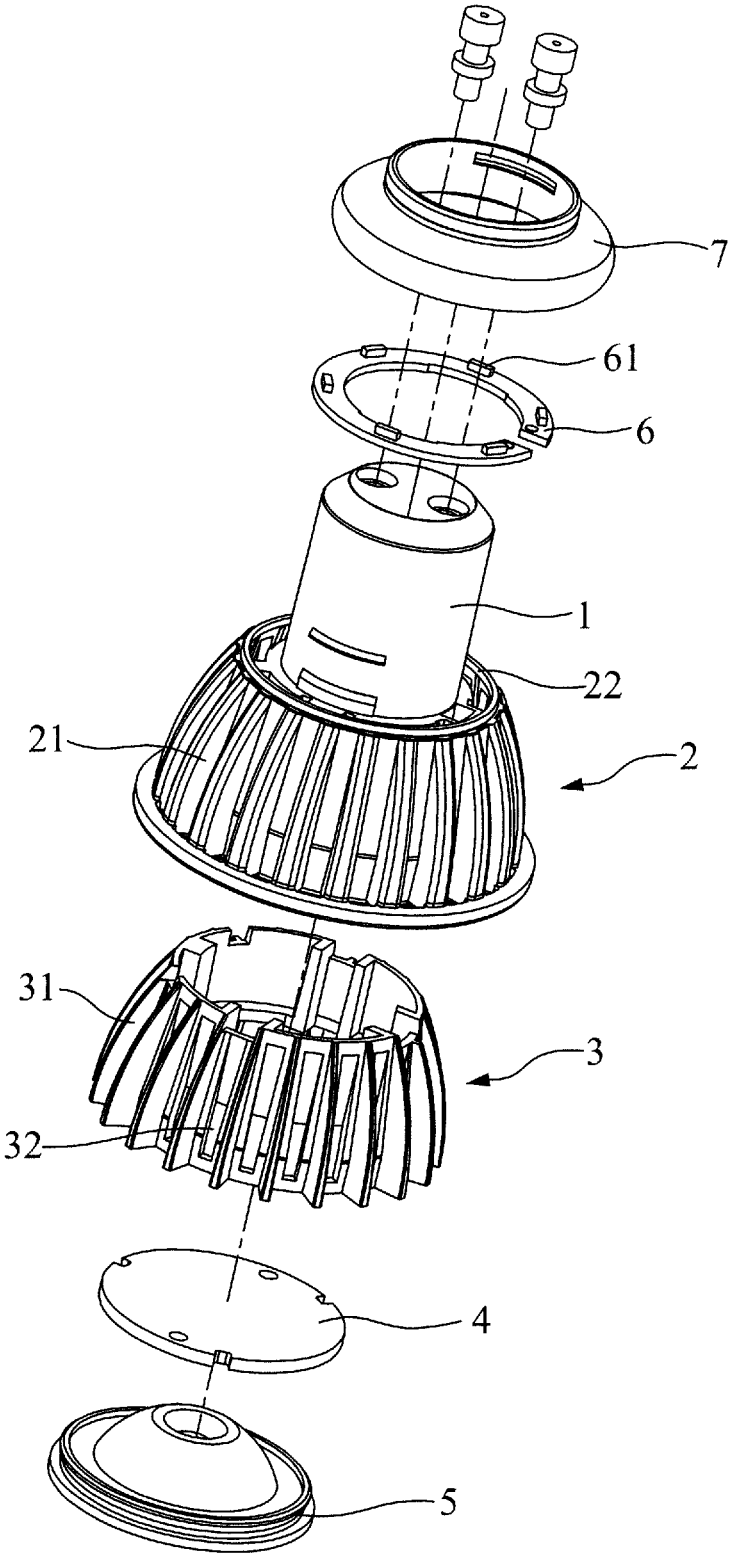
FIG. 2 is an exploded view of the present invention.
Figure 3:
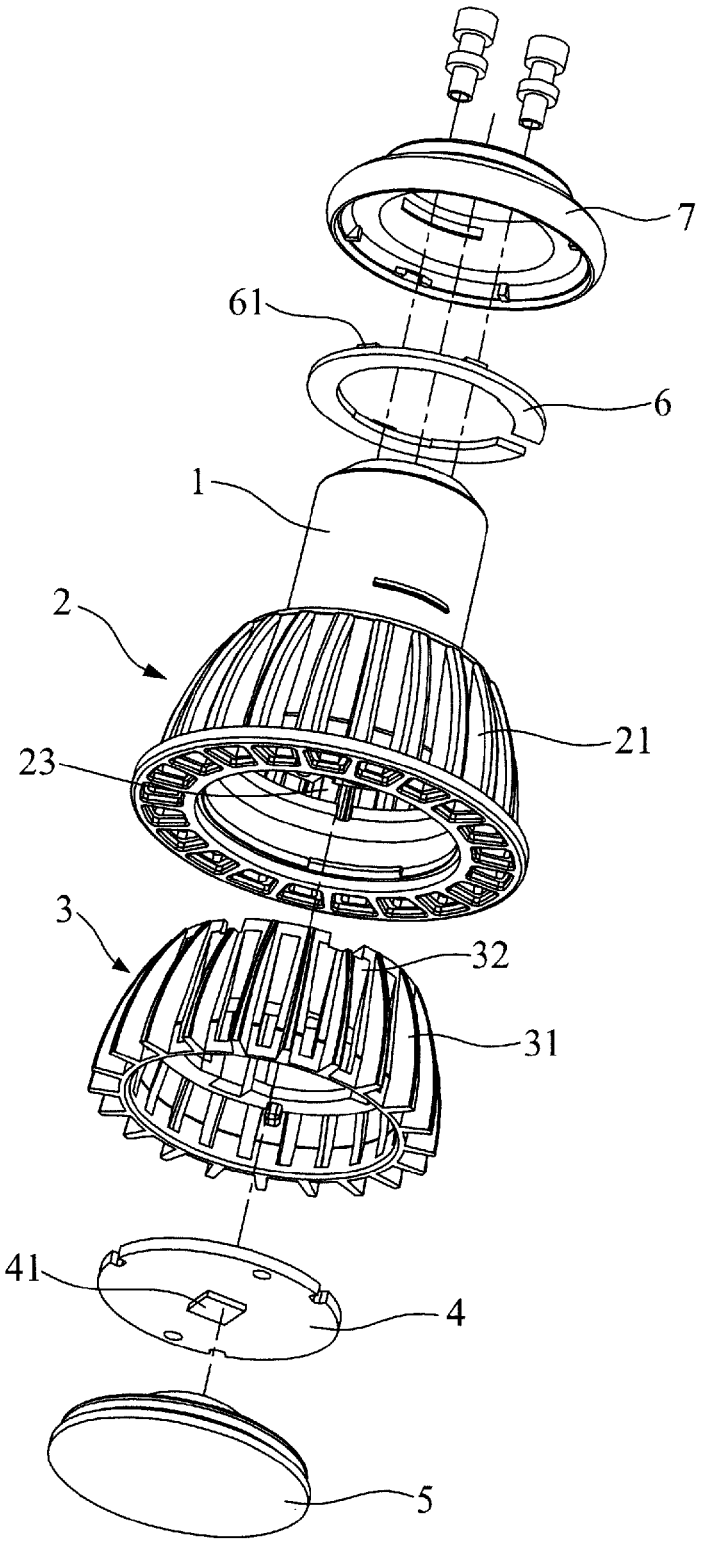
FIG. 3 is another exploded view of the present invention.
Figure 4:
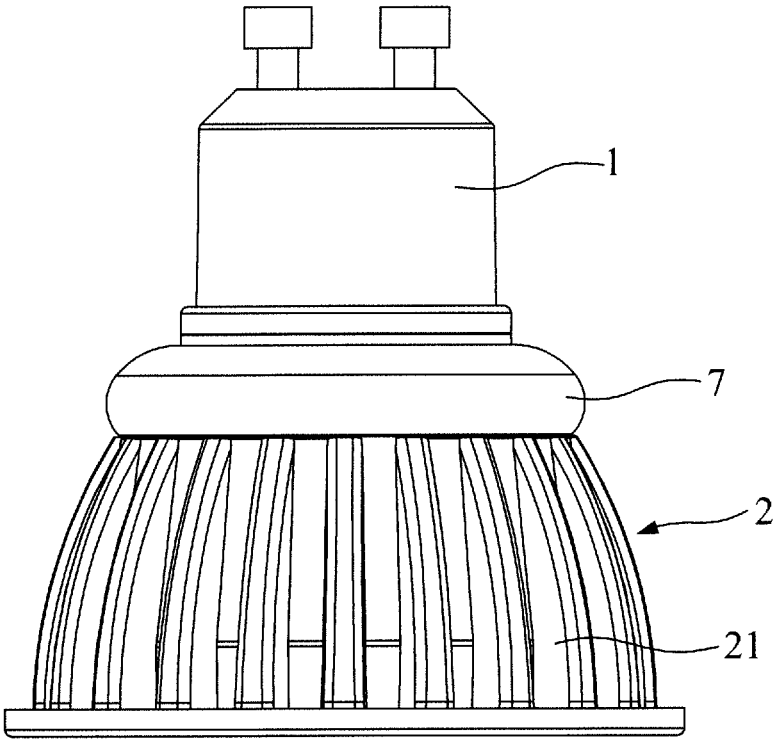
FIG. 4 is a schematic view of the present invention.
Figure 5:
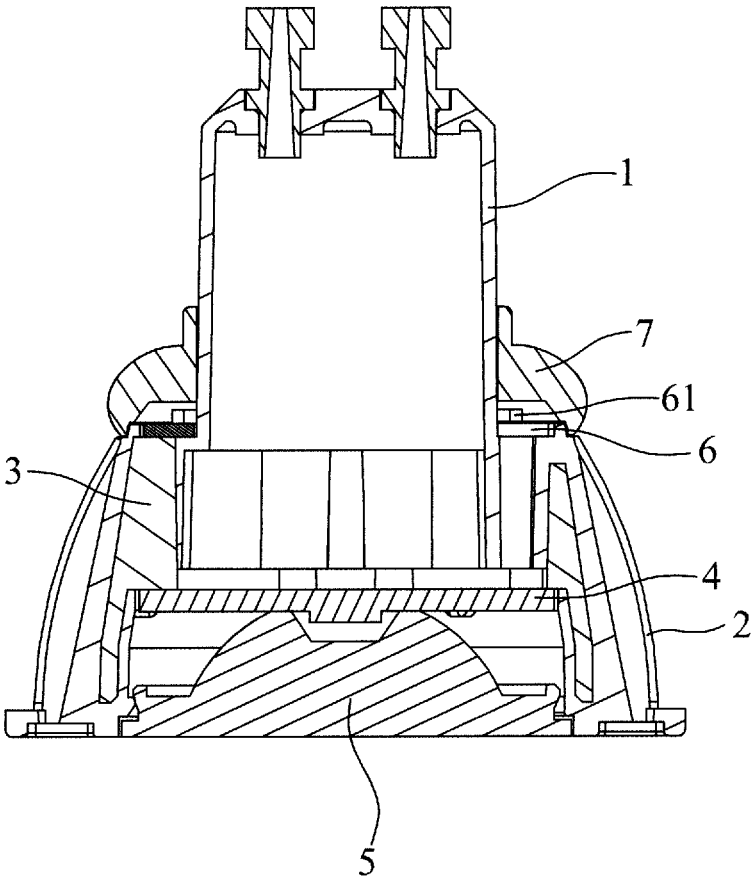
FIG. 5 is a cross-sectional view of the present invention.

As shown in FIGS. 2-5, the present invention discloses a double-sided light-emitting diode (LED) light structure, which comprises a casing 2 that comprises a base 1, a heat dissipation hood 3 arranged in the casing 2, a front chip 4 arranged in the heat dissipation hood 3 and electrically connected to the base 1 and comprising an LED illuminant 41, and a lens 5 arranged in front of the front chip 4. The features of the present invention are as follows:

The casing 2 has a rear portion in which a rear chip 6 that is electrically connected to the base and comprises an LED illuminant 61 is mounted. The rear chip 6 is also located at a rear end of the heat dissipation hood 3 to mate with the heat dissipation hood 3. The rear chip is housed in a light-transmittable rear cover 7 set thereon. The rear cover 7 can be a casing having a curved surface to expand light projection range.

The casing 2 is a horn like casing having an outer circumferential surface on which raised ribs 21 are distributed. The casing 2 has an inner surface in which recesses are formed and respectively correspond to the raised ribs 21. The casing 2 has a rear end mating the base 1 and defines a stepped surface 22 with respect to the base 1 for mating the rear chip 6.

The heat dissipation hood 3 is a metal cover corresponding to an internal cavity of the casing 2 and having an outer circumference on which heat dissipation fins 31 are distributed. The fins 31 are respectively in alignment with the recesses of the raised ribs 21 of the casing 2 and hollow openings 32 are defined between adjacent fins 31. Such an arrangement helps dissipate heat from the light. The heat dissipation hood 3 has an internal cavity in which a stepped seat 33 is provided for mating the front chip 4.

The lens 5 is fixedly mounted to a front end of the casing 2 and retains the heat dissipation hood 3 in position inside the casing 2.

The rear chip 6 is in the form of a ring or a ring having a side opening, which is fit over the base 1 to mate and locate on the step surface 22 of the casing 2 so as to be in contact engagement with the rear end of the heat dissipation hood 3, allowing heat to be transmitted therefrom to the heat dissipation hood 3 for heat dissipation.

The rear cover 7 is an annular cover that is exactly fit to and covers the rear chip 6 and is coupled to the casing 2.

The casing 2 can be formed of a plastic piece and is provided for protection of the light and having a function of dust protection. The casing 2 may alternatively be made of metal and has an outer surface on which raised ribs are formed to also serve as heat dissipation fins so that there is no need to provide the heat dissipation hood 3 and the front chip 4 may be directly set in the casing 2.

To assemble, the base 1 is fixed to the casing 2 and the heat dissipation hood 3 is mounted in the casing 2. The front chip 4 is mounted in the heat dissipation hood 3 and then, the lens 5 is fixed to the front end of the casing 2. The rear chip 6 and the rear cover 7 are then sequentially fit over the base 1 to be fixed to the rear end of the casing 2.

In summary, the present invention provides a double-sided LED light, which has a front end that achieves concentrated illumination and a rear end that achieves projection of supplemental light so that the LED light has a function of emitting light from two sides thereof to achieve a bettered three-dimensional illumination effect.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

We claim:

1. A double-sided light-emitting diode (LED) light structure, comprising a casing that comprises a base and a front chip arranged in the casing and electrically connected to the base and comprising an LED illuminant, wherein the casing has a rear end on which a rear chip that is electrically connected to the base and comprises an LED illuminant is mounted such that the rear chip is spaced from the front chip in an axial direction and is located axially rearward of the front chip with the rear end of the casing located between the front chip and the rear chip, a light-transmittable rear cover being set on and housing the rear chip;

wherein the rear chip is in the form of a ring or a ring having a side opening, which extends in a circumferential direction around the axial direction and is fit over and circumferentially extends around the base to mate the casing; and the rear cover is an annular cover extending in the circumferential direction and circumferentially surrounding the base.

2. The double-sided LED light structure according to claim 1, characterized in that the casing is made of metal and has an outer surface on which raised ribs are distributed.

3. The double-sided LED light structure according to claim 1, characterized in that the casing comprises a heat dissipation hood received therein and having an outer circumference on which heat dissipation fins are distributed, the front chip mating the heat dissipation hood and electrically connected to the base, the rear chip mating the rear end of the heat dissipation hood.

4. The double-sided LED light structure according to claim 3, characterized in that the heat dissipation hood is a metal cover corresponding to an internal cavity of the casing, hollow openings being formed between adjacent fins.

5. The double-sided LED light structure according to claim 4, characterized in that the heat dissipation hood is a metal cover corresponding to an internal cavity of the casing, hollow openings being formed between adjacent fins.

6. The double-sided LED light structure according to claim 3, characterized in that the casing is made of plastics and has an outer circumferential surface on which raised ribs are formed, the casing having an inner surface in which recesses are formed and respectively correspond to the raised ribs so as to correspond to the heat dissipation fins of the heat dissipation hood.

7. The double-sided LED light structure according to claim 1, characterized in that the casing has a front end to which a lens is mounted such that the lens is located frontward of the front chip in the axial direction.

8. The double-sided LED light structure according to claim 1, characterized in that the rear cover comprises a casing having a curved surface.

* * * * *